US012351948B2

(12) United States Patent
Bohl et al.

(10) Patent No.: US 12,351,948 B2
(45) Date of Patent: Jul. 8, 2025

(54) METHOD AND APPARATUS FOR MAKING NONWOVEN FABRIC OF CRIMPED SYNTHETIC FIBERS

(71) Applicants: ASAHI KASEI KABUSHIKI KAISHA, Tokyo (JP); REIFENHÄUSER GMBH & CO. KG MASCHINENFABRIK, Troisdorf (DE)

(72) Inventors: Patrick Bohl, Hennef (DE); Hans-Georg Geus, Niederkassel (DE); Sebastian Sommer, Troisdorf (DE); Tobias Wagner, Cologne (DE); Kazuya Zeisho, Tokyo (JP)

(73) Assignees: MITSUI CHEMICALS ASAHI LIFE MATERIALS CO. LTD, Tokyo (JP); REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 447 days.

(21) Appl. No.: 17/620,532

(22) PCT Filed: Jul. 7, 2020

(86) PCT No.: PCT/EP2020/069127
§ 371 (c)(1),
(2) Date: Dec. 17, 2021

(87) PCT Pub. No.: WO2021/018525
PCT Pub. Date: Feb. 4, 2021

(65) Prior Publication Data

US 2022/0316097 A1 Oct. 6, 2022

(30) Foreign Application Priority Data

Jul. 30, 2019 (EP) ..... 19189240

(51) Int. Cl.
*D04H 3/14* (2012.01)
*D01D 5/092* (2006.01)
(Continued)

(52) U.S. Cl.
CPC ..... *D01D 5/0985* (2013.01); *D01D 5/092* (2013.01); *D01D 5/22* (2013.01); *D01D 5/32* (2013.01);
(Continued)

(58) Field of Classification Search
CPC ..... D01D 5/0985; D01D 5/092; D01D 5/22; D01D 5/32; D01D 13/00; D01F 8/06; D04H 3/018; D04H 3/147; D04H 3/16
See application file for complete search history.

(56) References Cited

U.S. PATENT DOCUMENTS 3,394,435 A 7/1968 Knee
5,382,400 A * 1/1995 Pike ..... D04H 3/147 442/364
(Continued)

FOREIGN PATENT DOCUMENTS

EP 0594123 A1 * 4/1994

*Primary Examiner* — Ryan M Ochylski
(74) *Attorney, Agent, or Firm* — Andrew Wilford

(57) ABSTRACT

A method for producing a nonwoven fabric made of crimped synthetic fibers, wherein the synthetic fibers are spun and are deposited on a conveyor as a nonwoven web. The deposited nonwoven web is pre-bonded by means of at least one first hot-air bonding device, wherein a main suction air is sucked from below through the conveyor in the area of fiber deposition. A first suction air is sucked from below through the conveyor in the region of the first hot-air bonding device. The air speed of the main suction air is greater than the air speed of the first suction air.

15 Claims, 5 Drawing Sheets

Figure 1:
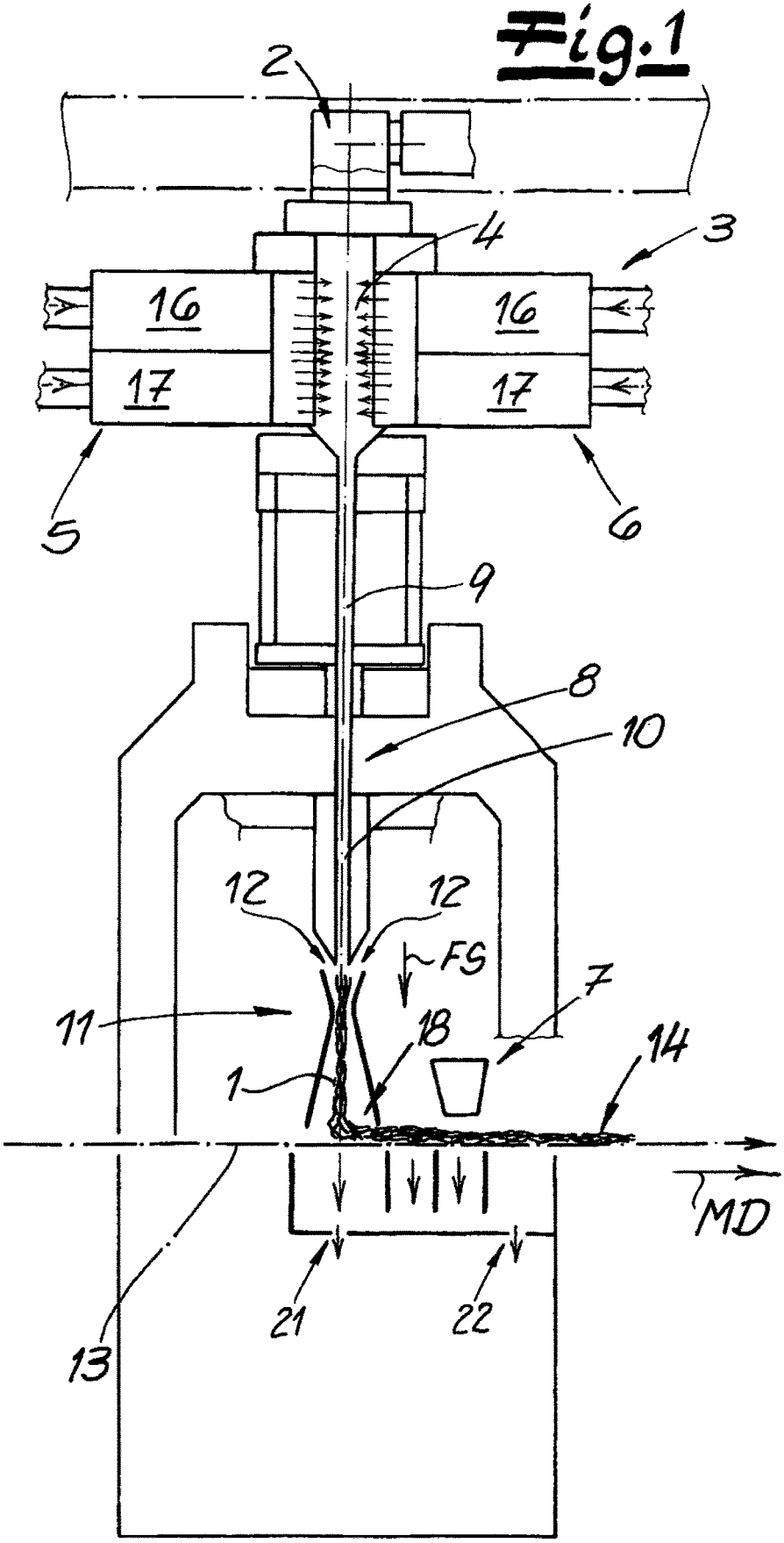

(51) Int. Cl.

| | |
|---|---|
| ***D01D 5/098*** | (2006.01) |
| ***D01D 5/22*** | (2006.01) |
| ***D01D 5/32*** | (2006.01) |
| ***D01D 5/34*** | (2006.01) |
| ***D01D 13/00*** | (2006.01) |
| ***D01F 8/06*** | (2006.01) |
| ***D04H 3/018*** | (2012.01) |
| ***D04H 3/147*** | (2012.01) |
| ***D04H 3/16*** | (2006.01) |

(52) U.S. Cl.

CPC ..... *D01D 5/34* (2013.01); *D01D 13/00* (2013.01); *D01F 8/06* (2013.01); *D04H 3/018* (2013.01); *D04H 3/147* (2013.01); *D04H 3/16* (2013.01); *D10B 2321/021* (2013.01); *D10B 2321/022* (2013.01)

(56) References Cited

U.S. PATENT DOCUMENTS

| | | | | |
|---|---|---|---|---|
| 2002/0089079 | A1* | 7/2002 | Shelley | D04H 3/018 264/168 |
| 2003/0003826 | A1* | 1/2003 | Rudisill | D04H 3/147 442/364 |
| 2003/0161904 | A1* | 8/2003 | Geus | D04H 3/033 425/72.2 |
| 2005/0245157 | A1 | 11/2005 | Kepner | |
| 2017/0314163 | A1 | 11/2017 | Sommer | |
| 2020/0173077 | A1* | 6/2020 | Brennan | D04H 3/147 |

* cited by examiner 2
3
4
16
16
17
17
5
6
9
8
10
12
12
FS
7
11
18
14
1
MD
21
22
13

METHOD AND APPARATUS FOR MAKING NONWOVEN FABRIC OF CRIMPED SYNTHETIC FIBERS

CROSS REFERENCE TO RELATED APPLICATIONS

This application is the US-national stage of PCT application PCT/EP2020/069127 filed 7 Jul. 2020 and claiming the priority of European patent application 19189240.5 itself filed 30 Jul. 2019.

DESCRIPTION

The invention relates to a method for producing a nonwoven fabric made of crimped synthetic fibers, wherein the synthetic fibers are spun and are deposited on a conveyor as a nonwoven web. The invention further relates to a corresponding apparatus for producing a nonwoven web made of crimped synthetic fibers. It lies within the framework of the invention that the crimping synthetic fibers comprise latently crimping synthetic fibers. Furthermore, it lies within the framework of the invention that crimped continuous synthetic filaments are used as crimped continuous filaments.

Methods for producing nonwoven fabrics made of crimped synthetic fibers are known from practice in various configurations. This applies particularly to spunbond webs which are produced by the spunbond method. For many applications it is desirable in this case that the spunbond webs have a high voluminosity and at the same time also a sufficient stability or strength. However, within the framework of producing spunbond webs, these two properties usually comprise competing properties or effects. A high voluminosity is frequently achieved at the expense of the strength and conversely. It is also desirable that spunbond webs have a sufficient homogeneity. For economic reasons a high production speed is desired during the production of spunbond webs. In order to achieve a high production speed during the production of voluminous spunbond webs, it is usually necessary to accept losses in the strength and in the homogeneity of the spunbond web. These are very undesirable disadvantages. In this respect, there is a need for improvement.

In the course of producing spunbond webs, it is also known that the nonwoven web deposited on a foraminous deposition belt is stabilized by means of air sucked through the foraminous deposition belt. There is then the problem that the nonwoven web transferred with the foraminous deposition belt from a suctioned region into a non-suctioned region is subjected to a so-called blow-back effect. At the beginning of the non-suctioned region the further conveyed fibers of the nonwoven web are as it were sucked back by the suction air of the suctioned region so that perturbing inhomogeneities are formed in the nonwoven web. The homogeneity of the nonwoven web then frequently leaves something to be desired.

The invention is based on the technical problem of providing a method of the type mentioned initially by means of which voluminous nonwoven webs which nevertheless have a satisfactory stability or strength as well as an optimal homogeneity can be produced at high production speed. The invention is further based on the technical problem of providing a corresponding apparatus to produce such a nonwoven fabric.

In order to solve the technical problem, the invention teaches a method for producing a nonwoven fabric made of crimped synthetic fibers, wherein the synthetic fibers are spun and deposited on a conveyor as a nonwoven web, wherein the deposited nonwoven web is pre-bonded by means of a first hot-air bonding device, wherein a main suction air is sucked from below through the conveyor in the area of fiber deposition, wherein a first suction air is sucked from below through the conveyor in the region of the first hot-air bonding device and wherein the air speed of the main suction air is greater than the air speed of the first suction air.

It lies within the framework of the invention and is preferred that the synthetic fibers receive a final hot-air bonding after the first hot-air bonding. One possible final hot-air bonding is accomplished by using a belt oven. In such a belt oven, hot air is flowing through the fibers to solidify and create the final product. In a preferred embodiment, the hot-air temperature and air speed used is lower than in the first hot-air bonding.

By means of the first hot-air bonding device, a first hot air flow is produced which expediently acts from above onto the nonwoven web and brings about a pre-bonding. It lies within the framework of the invention that the main suction air is sucked through the conveyor under the deposition area of the fibers. It furthermore lies within the framework of the invention that the first suction air is sucked through the conveyer under the hot-air bonding device. A particularly recommended embodiment of the invention is characterized in that the conveyor is configured as a foraminous deposition belt or as a continuously circulating foraminous deposition belt.

It lies within the framework of the method according to the invention that the nonwoven fabric is produced as a spunbond nonwoven fabric, wherein continuous synthetic filaments are spun, cooled and then stretched and are then deposited as a spunbond nonwoven web on the conveyor or on the foraminous deposition belt. The synthetic fibers used within the framework of the invention therefore comprise continuous synthetic filaments.

A particularly preferred embodiment of a spunbond method according to the invention or a spunbond apparatus according to the invention for carrying out the method is described hereinafter. Expediently, the continuous filaments—in particular in the form of bicomponent filaments and/or multicomponent filaments—are spun with the aid of a spinneret and then guided through a cooling device to cool the filaments. Preferably at least one monomer suction device is disposed between the spinneret and the cooling device by means of which a suction from the filament forming space takes place directly under the spinneret so that in addition to air, primarily the gases produced during spinning of the filaments in the form of decomposition products, monomers, oligomers and the like can be removed from the apparatus. It is recommended that the filament curtain produced by the spinneret in the cooling device is exposed to cooling air from opposite sides. A very preferred embodiment—which has particular importance within the framework of the method according to the invention—is characterized in that the cooling device is divided into at least two cooling chamber sections arranged consecutively in the flow direction of the filaments, into which preferably cooling air at different temperature can be supplied. It has proved successful that in the flow direction of the filaments a stretching device is provided after or underneath the cooling device, by means of which the filaments running through the cooling device are drawn or stretched. Expediently, the cooling device is directly adjoined by an intermediate channel which is preferably configured to be converging for filament deposition or converges in a wedge shape. After running through the intermediate channel, the filament curtain preferably enters into a draw-down channel or stretching shaft of the stretching device. A very recommended embodiment of the invention is characterized in that the unit formed from the cooling device and the stretching device or the unit formed from the cooling device and the intermediate channel as well as the stretching shaft is a closed unit. Closed unit means here that apart from the supply of cooling air in the cooling device, no further air is supplied into this unit and the unit is thus configured to be closed towards the outside.

A preferred embodiment of the invention is further characterized in that the continuous filaments emerging from the stretching device are guided through a laying unit which comprises at least one diffuser. According to one embodiment, at least two consecutively arranged diffusers are provided. Expediently after running through the laying unit or after running through the at least one diffuser, the filaments are deposited on the conveyor or on the foraminous deposition belt. There the filaments are deposited to form the spunbond web.

It lies within the framework of the invention that a diffuser used within the framework of the method according to the invention has two opposite diffuser walls which extend transversely to the machine direction and therefore in the CD direction. Machine direction means within the framework of the invention in particular the conveying direction of the nonwoven web on the foraminous deposition belt. According to a very recommended embodiment of the invention, the distance of the at least one diffuser from the foraminous deposition belt is adjustable. This comprises in particular the distance of the diffuser arranged directly above the foraminous deposition belt. Furthermore, it is preferred within the framework of the invention that the distance between the diffuser walls and/or the angle between the diffuser walls is adjustable. Particularly the adjustment of the distance between the foraminous deposition belt and the diffuser arranged directly above the foraminous deposition belt has particular importance within the framework of the invention and with a view to the solution of the technical problem according to the invention. Preferably the distance between the foraminous deposition belt and the diffuser is between 5 mm and 150 mm, particularly preferably between 5 mm and 100 mm.

A particularly recommended embodiment of the invention is characterized in that within the framework of the method according to the invention a multilayer nonwoven web is produced, wherein the nonwoven layers or spunbond layers used here are preferably each produced according to the previously described method or using the previously described apparatus. Then at least one spinneret or at least one spinning beam is assigned to each nonwoven layer. According to a particularly preferred embodiment, the measures according to the invention described hereinbefore and hereinafter in connection with the treatment of the nonwoven web on the conveyor (in particular pre-bonding measures and/or suction measures) are implemented after application of each nonwoven layer onto the conveyor or onto the foraminous deposition belt. Expediently these measures are implemented for at least a portion of the nonwoven layers of a nonwoven laminate.

It lies within the framework of the invention that the synthetic fibers or the continuous filaments are spun as bicomponent filaments and/or multicomponent filaments. Preferably in this case at least one component or synthetic component consists of a polyolefin or substantially of a polyolefin. A very recommended embodiment is characterized in that in the bicomponent filaments or multicomponent filaments, at least two components or at least two synthetic components comprise polyolefin or consist of polyolefin or substantially consist of polyolefin. A proven embodiment of the invention is characterized in that the bicomponent filaments and/or multicomponent filaments are spun with side-by-side configuration and/or with an eccentric core-sheath configuration. In principle, other configurations of the bicomponent filaments and/or multicomponent filaments are possible which allow a latent crimping of the filaments.

Preferably used within the framework of the invention are bicomponent filaments and/or multicomponent filaments in which at least one component comprises polypropylene and/or polyethylene or consist or substantially consists of polypropylene and/or polyethylene. According to a recommended embodiment, bicomponent filaments are produced of which one component comprises polypropylene or consists of or substantially consists of polypropylene and the other component comprises polyethylene or consists of or substantially consists of polyethylene. These bicomponent filaments are proven to have a side-by-side configuration and/or an eccentric core-sheath configuration. If one component of the bicomponent filaments comprises polypropylene or consists of or substantially consists of polypropylene and the other component comprises polyethylene or consists of or substantially consists of polyethylene, the mass ratio of the two components polypropylene: polyethylene is preferably 20:80 to 80:20. When using a polypropylene it is recommended that a polypropylene is selected having a melt flow rate (MFR) which is 25 to 100 g/10 min (230° C./2.16 kg), preferably 30 to 80 g/10 min, very preferably 35 to 60 g/10 min.

It lies within the framework of the invention that the first hot-air bonding device blows a first hot air for pre-bonding the nonwoven web, wherein the air speed of the main suction air is greater than the air speed of the first hot air. Preferably the air speed of the first suction air is greater than or equal to the air speed of the first hot air of the first hot-air bonding device.

According to a preferred embodiment of the invention, a second suction air is sucked from below through the conveyor or from below through the foraminous deposition belt between the area of fiber deposition and the region of the first hot-air bonding device. In the conveying direction of the nonwoven web, the area of fiber deposition, the region of suction of the second suction air and the region of the first hot air bonding device are then arranged consecutively. In this case, it also lies within the framework of the invention that in the conveying direction of the nonwoven web, the suction of the main suction air, the suction of the second suction air and the suction of the first suction are arranged consecutively or directly consecutively.

Expediently the air speed of the second suction air is less than the air speed of the main suction air. Preferably the air speed of the main suction air is between 5 m/s and 25 m/s, very preferably between 8 m/s and 20 m/s, further very preferably between 10 m/s and 15 m/s and expediently the air speed of the second suction air is between 2 m/s and 15 m/s, very preferably between 3 m/s and 12 m/s, further very preferably between 5 m/s and 10 m/s. It is recommended that the air speed of the second suction air is greater than the air speed of the first suction air. Preferably the air speed of the second suction air is 10% to 50% greater than the air speed of the first suction air, particularly preferably 15% to 30% greater than the air speed of the first suction air and very particularly preferably 18% to 25% greater than the air speed of the first suction air.

Expediently the first hot-air bonding device is configured as a hot air knife. It is recommended that the distance of the first hot air device from the conveyor or from the foraminous deposition belt can be adjusted. Preferably the distance of the first hot-air bonding device from the conveyor or from the foraminous deposition belt is between 2 mm and 50 mm, particularly preferably between 5 mm and 25 mm. It is further recommended that the angle between the hot air emerging from the first hot air bonding and the conveyor or the foraminous deposition belt can be adjusted. According to one embodiment the angle between the hot air emerging from the first hot air bonding and the conveyor or the foraminous deposition belt is 90° and preferably it can be adjusted in the range +/−20°. A preferred embodiment of the invention is characterized in that the temperature of the hot air of the first hot-air bonding device or the first hot air knife can be adjusted. Preferably the temperature of the hot air blown from the first hot-air bonding device is 80 to 180° C., preferably 100 to 175° C. and very preferably 125° C. to 170° C.

An embodiment which has particular importance within the framework of the invention is characterized in that after the first hot air bonding device provided in the conveying direction of the nonwoven web, the nonwoven web is bonded or pre-bonded by means of a second hot-air bonding device, wherein a second hot air is blown by the second hot-air bonding device onto the nonwoven web.

According to a recommended embodiment of the invention, preferably the distance of the second hot-air bonding device from the conveyor or from the foraminous deposition belt can be adjusted. Preferably the distance of the second hot-air bonding device from the conveyor or from the foraminous deposition belt is between 10 mm and 300 mm, particularly preferably between 50 mm and 200 mm.

Preferably the angle between the hot air blow from the second hot-air bonding device and the conveyor or the foraminous deposition belt is around 90° and can be adjusted by 0-10° to either side. Expediently the second hot-air bonding device is configured as a hot air knife or as a hot air oven. It is recommended that the temperature of the hot air blow from the second hot-air bonding device can be adjusted. Preferably the temperature of the hot air blow from the second hot-air bonding device is 80 to 180° C., preferably 100 to 155° C. and very preferably 125° C. to 145° C.

A very preferred embodiment of the method according to the invention is characterized in that the air speed of the first hot air of the first hot-air bonding device is greater than the air speed of the second hot air of the second hot-air bonding device.

Preferably the air speed of the first hot air of the first hot-air bonding device is between 1 m/s and 5 m/s (for example 2,6 m/s), very preferably between 1.5 m/s and 4 m/s and further very preferably less than 3 m/s. and the air speed of the second hot air of the second hot-air bonding device is preferably 10% to 50% lower, particularly 15% to 30% lower (for example 2,0 m/s), very preferably 18% to 30% lower than the air speed of the first hot air of the first hot-air bonding device.

Expediently the first hot air of the first hot-air bonding device has a higher temperature than the second hot air of the second hot-air bonding device. A proven embodiment of the invention is characterized in that the first hot-air bonding device has a smaller air treatment area or a shorter pre-bonding area with respect to the treated nonwoven web when viewed in the conveying direction of the nonwoven web than the second hot-air bonding device. The air treatment area and therefore the pre-bonding area of the second hot-air bonding device is therefore—when viewed in the conveying direction of the nonwoven web—is between 35 mm and 110 mm and the width of the outlet aperture for the second hot air of the second hot-air bonding device (in conveying direction) is between 110 mm and 1100 mm.

It lies within the framework of the invention that the first hot air of the first hot-air bonding device has a different temperature and/or a different air speed and/or a different air treatment cross-section than the second hot air of the second hot-air bonding device. In this case, it furthermore lies within the framework of the invention that the first hot air of the first hot-air bonding device has a higher temperature and/or a higher air speed and/or a smaller air treatment cross-section in relation to the nonwoven web to be pre-bonded than the second hot air of the second hot-air bonding in order to create a cooling gradient.

A very recommended embodiment of the invention is characterized in that a third suction air is sucked from below through the conveyor or through the foraminous deposition belt in the area of the second hot air bonding device. Preferably the air speed of the third suction air is less than the air speed of the second hot air emerging from the second hot-air bonding device. A very recommended embodiment of the invention is further characterized in that the air speed of the main suction air is greater than the air speed of the second hot air emerging from the second hot-air bonding device.

Preferably the air speed of the second hot air is between 1,1 m/s and 2,6 m/s, particularly preferably between 1,2 m/s and 2,4 m/s. It is recommended that the air speed of the first suction air is greater than the air speed of the second hot air emerging from the second hot-air bonding device.

A particular embodiment of the invention is characterized in that between the region of suction of the first suction air and the region of suction of the third suction air, a fourth suction air is sucked from below through the conveyor or the foraminous deposition belt. Preferably the air speed of the fourth suction air is less than the air speed of the first suction air. Expediently the air speed of the fourth suction air is greater than the air speed of the third suction air. It therefore lies within the framework of the invention that in the conveying direction of the nonwoven web, the suction of the first suction air, the suction of the fourth suction air and the suction of the third suction air are arranged consecutively. Expediently in this case the air speed decreases from the suction of the first suction air to the suction of the third suction air. The first suction air then therefore has the highest air speed of the three suction airs, the fourth suction air has the second highest air speed and the third suction air has the third highest air speed, especially in order to be adapted to the preferred gradient of hot air speed and to the already existing degree of bonding.

It lies within the framework of the invention that the first hot-air bonding device and/or the second hot-air bonding device is/are formed as precompaction device(s) for the nonwoven web. Preferably both—the first and the second hot-air bonding device—are designed as precompaction devices. Furthermore, it lies within the framework of the invention that after this precompaction or after the precompactions in the conveying direction of the filaments, the nonwoven web is finally solidified. Preferably the nonwoven web is finally solidified with hot air. According to a recommended embodiment of the invention, a precompaction firstly takes place with the first hot-air bonding device, then a further precompaction by means of the second hot-air bonding device and finally a final solidification by means of a final solidification device, wherein the final solidification preferably takes place with hot air.

It lies within the framework of the invention that in the method according to the invention the conveying speed of the nonwoven web is more than 120 m/min, preferably more than 130 m/min, preferably more than 140 m/min and very preferably more than 150 m/min. Thus, within the framework of the invention it is possible to operate at a relatively high production speed of, for example, 150 m/min or more. The invention is in this case based on the finding that nevertheless a stable nonwoven web having high voluminosity and high homogeneity as well as strength can be achieved. Of importance here is also that a fiber deposition with controllable alignment of the filaments in the machine direction (MD) and transversely to the machine direction (CD) can be achieved. Thus, the method according to the invention allows an easily controllable MD/CD ratio. As a result of the degrees of freedom according to the invention in the parameters ranges, this ratio is controllable and can be set precisely and reproducibly. The homogeneity of the nonwoven web meets all the requirements if the rules according to the invention are observed. According to the invention, a nonwoven web having high voluminosity and high strength can be produced and specifically in an advantageous manner at a high production speed. The invention is further based on the finding that when implementing the air flows according to the invention and in particular the suction measures according to the invention, the initially described disadvantageous blow-back effects can be avoided. This also significantly contributes to the fact that homogeneous nonwoven webs can be produced. It lies within the framework of the invention that when implementing the measures according to the invention, a nonwoven web according to the invention can easily be produced from a plurality of layers arranged one above the other. Such a nonwoven laminate or each layer of the nonwoven laminate can thus also be produced in a simple manner using the air application measures or hot air applications according to the invention.

According to a preferred embodiment of the method according to the invention, a nonwoven web or a spunbond web having a bulk density of 0.06 g/cm3 or less is produced, preferably having a bulk density of 0.05 g/cm3 or less and particularly preferably having a density of 0.04 g/cm3 or less. It lies within the framework of the invention that a nonwoven web or a spunbond web is produced by the method according to the invention, which has a strength between 0.6 and 2.0 (N/5 cm)/(g/m2) or more. The strength in the machine direction (MD) is preferably 20 N/5 cm or more, expediently 25 N/5 cm or more and preferably 30 N/5 cm or more. These values and value ranges of bulk density and strength are especially preferred for nonwoven webs with basis weight between 10 gsm and 50 gsm, preferably between 15 gsm and 35 gsm and very preferably between 17 gsm and 25 gsm.

The "Bulk density" used herein is the specific density calculated from the "mass per unit area" against the thickness and expressed in "g/cm3".

Mass per unit area is measured according to WSP (World strategic partners) 130.1 (2005). The tested area of min. 50.000 $mm^2$ is to be taken across a representative area of the web, like evenly across the width of a line and the average number computed.

The thickness is herein tested based on WSP 120.6 (2005)—option A. Test pressure of the pressure foot against the sample is 0.5 kPa as per standard, however the reading is taken after a contact time of 5 sec. At least 10 measurements from specimen taken from the same representative positions should be performed and the average number used to calculate the bulk density.

The tensile test standard used herein is WSP 110.04 (05)—Option B, using a specimen of 50×200 mm size, a pre-tension load of 0.5 N, a clamping distance of 100 mm and a testing speed of 200 mm/min. At least 10 specimen for MD and CD direction each should be taken from representative positions and the results averaged. The result is to be expressed as N/5 cm (width).

The invention also relates to an apparatus for producing a nonwoven fabric made of crimped synthetic fibers, with a spinning device or with a spinneret for spinning of the fibers, wherein a cooling device is provided for cooling the fibers and a conveyor for depositing the fibers for the nonwoven web, wherein a main suction area is provided immediately below the area of fiber deposition in which main suction area main suction air can be sucked from below through the conveyor, wherein in conveying direction of the conveyor or in conveying direction of the nonwoven web downstream of the area of fiber deposition, a first hot-air bonding device is provided which acts on the nonwoven web surface with a first hot air and wherein a first suction region is provided immediately below the first hot-air bonding device, in which a first suction air can be sucked from below through the conveyor and through the nonwoven web.

It lies within the framework of the invention that the apparatus is designed as a spunbond apparatus for producing nonwoven fabrics from continuous filaments, wherein after the cooling device in the conveying direction of the filaments, a stretching device for stretching the filaments is arranged and wherein between the stretching device and the conveyor at least one diffuser is arranged. A particularly preferred embodiment of the apparatus according to the invention is characterized in that the aggregate of the cooling device and the stretching device is formed as a closed unit, in which—except for the supply of cooling air—no further air supply is comprised.

Figure 2:
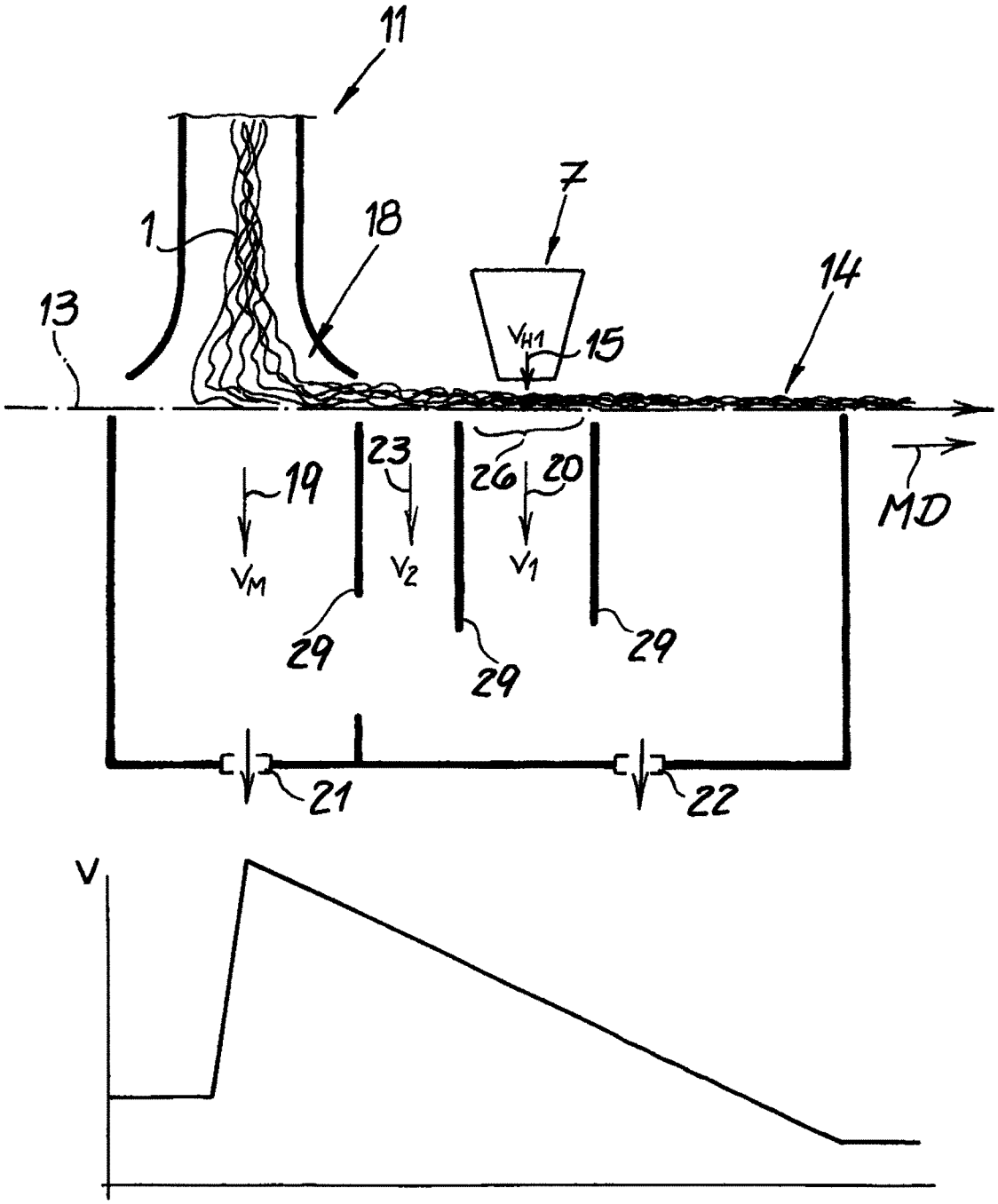
Figure 3:
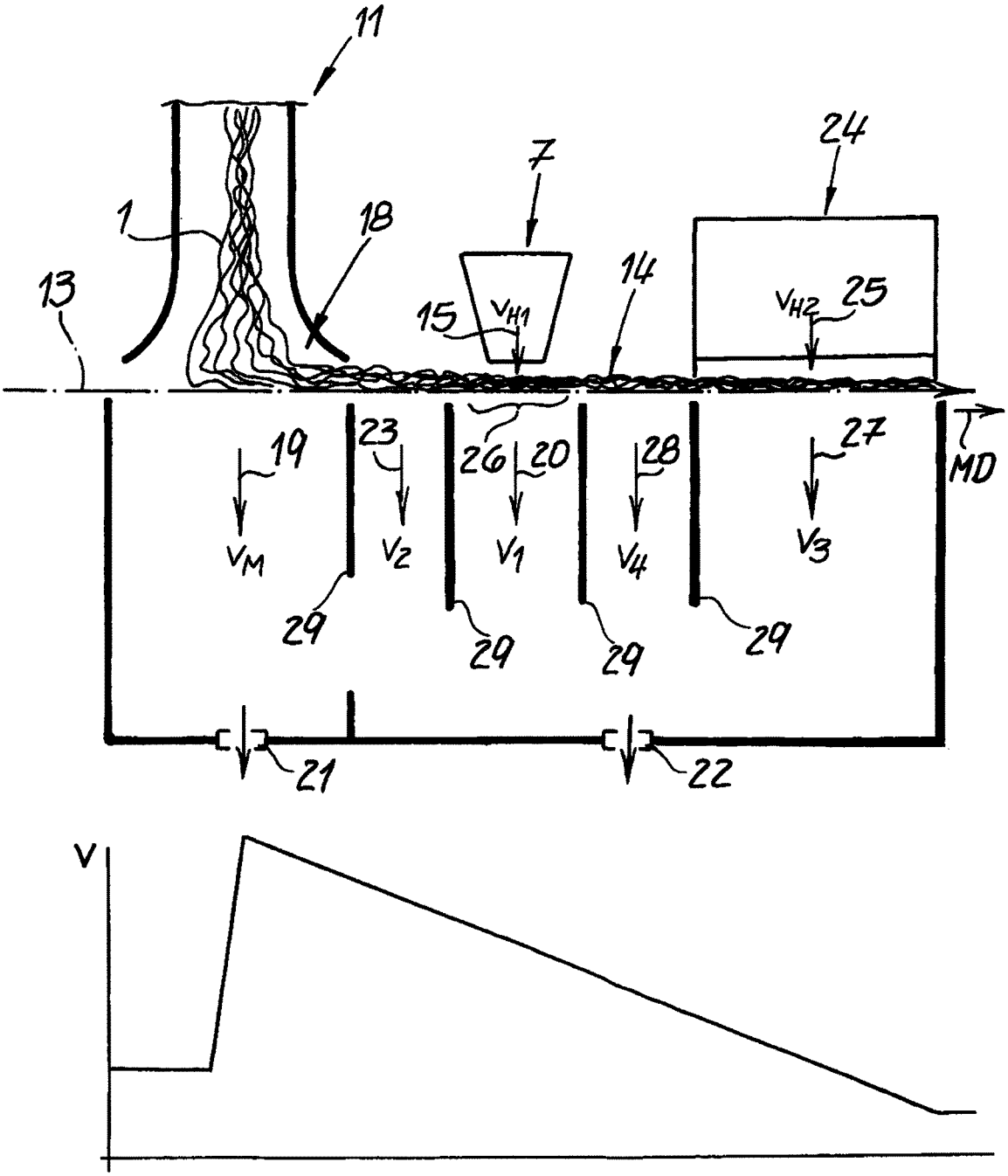
Figure 4:
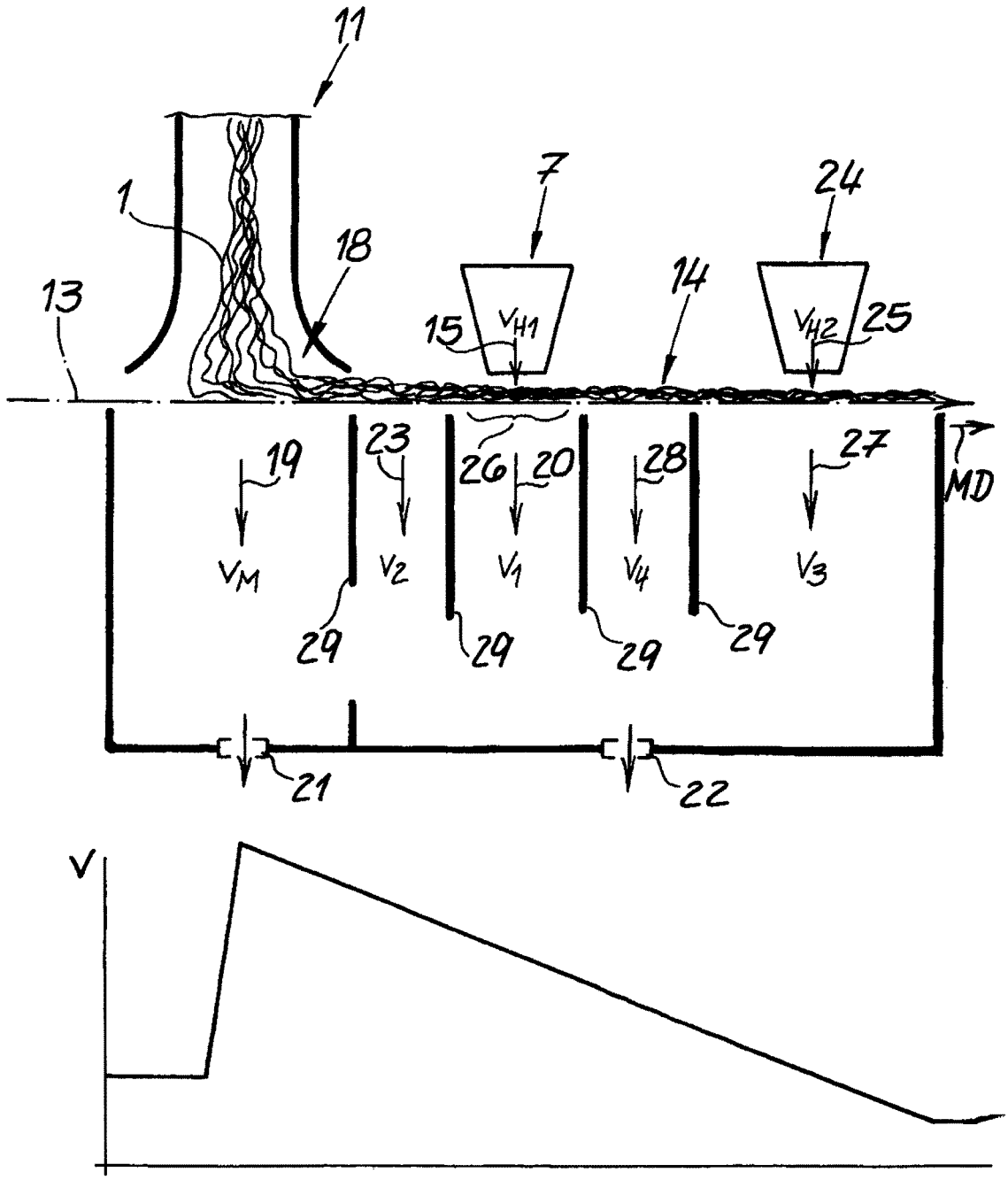
Figure 5:
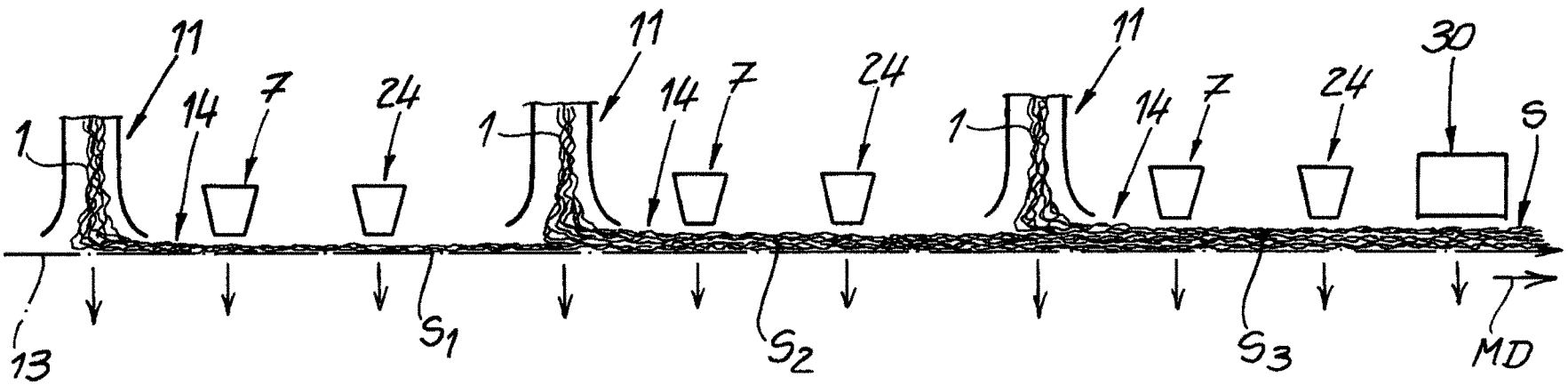

The invention is explained in detail hereinafter by means of drawings showing merely one exemplary embodiment. In schematic view:

FIG. 1 shows a vertical section through an apparatus according to the invention for carrying out the method according to the invention, FIG. 2 shows a section from FIG. 1 in the region of the foraminous deposition belt, FIG. 3 shows the subject matter according to FIG. 2 in a different embodiment, FIG. 4 shows the subject matter according to FIG. 2 in a further embodiment, FIG. 5 shows the apparatus according to the invention in the form of a multibeam system for producing a nonwoven web laminate from a plurality of spunbond webs, The figures show an apparatus according to the invention for carrying out the method according to the invention for producing a nonwoven web 14 in the form of a spunbond web made of crimped continuous filaments 1. These are crimped synthetic continuous filaments 1 which preferably and in the exemplary embodiment are formed as bicomponent filaments. It lies within the framework of the invention in this case that each of the two components comprises a polyolefin or consists of a polyolefin or substantially consists of a polyolefin. Preferably one component is a polypropylene and the other component is a polyethylene.

FIG. 1 show a very preferred embodiment of such an apparatus. This apparatus comprises a spinneret 2 for spinning the continuous filaments 1. The spun continuous filaments 1 are introduced into a cooling device with a cooling chamber 4 and with air supply cabins 5, 6 arranged on two opposite sides of the cooling chamber 4. The cooling chamber 4 and the air supply cabins 5, 6 extend transversely to the machine direction MD and therefore in the CD direction of the apparatus. Cooling air is introduced into the cooling chamber 4 from the opposite air supply cabins 5, 6.

According to a preferred embodiment and in the exemplary embodiment, each air supply cabin 5, 6 is divided into two cabin sections 16, 17 from which cooling air at different temperature is supplied in each case. In the exemplary embodiment cooling air at a first temperature can be supplied in each case from the upper cabin sections 16 whilst cooling air at a second temperature different from the first temperature can be supplied in each case from the two lower cabin sections 17. The division of the air supply cabins 5, 6 or the cooling chamber 4 into two has importance within the framework of the invention. It has been shown that the technical problem according to the invention can be solved particularly effectively and reliably with such a two-part or multipart cooling chamber.

In the filament flow direction FS a stretching device 8 is located downstream of the cooling device 3, by means of which the continuous filaments 1 are stretched. The stretching device 8 preferably and in the exemplary embodiment has an intermediate channel 9 which connects the cooling device 3 to a stretching shaft 10 of the stretching device 8. A particularly recommended embodiment of the invention is characterized in that the aggregate of the cooling device 3 and the stretching device 8 or the unit of the cooling device 3, the intermediate channel 9 and the stretching shaft 10 is configured as a closed system. Closed system means in this case in particular that apart from the supply of cooling air in the cooling device 3 there is no further supply of air in this aggregate. Accordingly the apparatus in FIG. 1 is constructed.

It has been proven and in the exemplary embodiment in the filament flow direction FS the stretching device 8 is followed by a diffuser 11 through which the continuous filaments 1 are guided. According to a preferred embodiment and in the exemplary embodiment, secondary air inlet gaps 12 for introducing secondary air into the diffuser 11 are provided between the stretching device 8 or between the stretching shaft 10 and the diffuser 11. This introduction of secondary air also has particularly advantageous importance within the framework of the invention. Instead of merely one diffuser 11 in FIG. 1, for example two diffusers 11 can also be arranged consecutively or above one another in the filament flow direction FS of the continuous filaments 1. A very recommended embodiment is characterized in that the distance between the diffuser 11 arranged directly above the foraminous deposition belt 13 and the foraminous deposition belt 13 can be adjusted. This adjustment of the distance between the lower edge of the diffuser 11 and the foraminous deposition belt 13 also has importance within the framework of the invention. Preferably the distance between the lower edge of the diffuser 11 and the foraminous deposition belt 13 is between 5 mm and 150 mm.

After running through the diffuser 11, the continuous filaments 1 are preferably and in the exemplary embodiment deposited on a conveyor configured as foraminous deposition belt 13. The foraminous deposition belt 13 is recommendedly and in the exemplary embodiment designed as a continuously circulating foraminous deposition belt 13. The filament deposition or the nonwoven web 14 is conveyed away or removed in the machine direction MD.

FIG. 2 shows a first preferred embodiment of the apparatus according to the invention. The deposited nonwoven web is here precompacted using a (first) hot-air bonding device 7. In this case, the nonwoven web 14 is acted upon from above by (first) hot air by means of the (first) hot-air bonding device 7 and thereby precompacted. This (first) hot air 15 is preferably adjustable with respect to its temperature and/or with respect to its air speed $v_{VH1}$. It is recommended and in the exemplary embodiment that the angle of the first hot-air bonding device 7 or the angle of the (first) hot air 15 with respect to the nonwoven web 14 or with respect to the foraminous deposition belt 13 is adjustable.

According to the invention, in the area 18 of fiber deposition a main suction air 19 is sucked through the foraminous deposition belt 13. Furthermore, according to the invention in the area of the (first) hot-air bonding device 7 a first suction air 20 is sucked through the foraminous deposition belt 13 or through the nonwoven web 14 resting on the foraminous deposition belt 13. For suction of the air flows, expediently fans 21, 22 are provided underneath the foraminous deposition belt 13.

It lies within the framework of the invention that the air speed $v_M$ of the main suction air 19 is greater than the air speed $v_1$ of the first suction air 20. Furthermore the air speed $v_M$ of the main suction air 19 is preferably and in the exemplary embodiment greater than the air speed $v_{H1}$ of the (first) hot air 15. According to one embodiment the air speed $v_M$ is between 10 m/s and 25 m/s and speed $v_{H1}$ of the (first) hot air is between 1,5 m/s and 3 m/s. It is recommended and in the exemplary embodiment that the air speed $v_1$ of the first suction air 20 is greater than the air speed $v_{H1}$ of the (first) hot air 15.

Preferably and in the exemplary embodiment of FIG. 2, a second suction air 23 is sucked between the suction of the main suction air 19 and the suction of the first suction air 20. Expediently the air speed $v_2$ of this second suction air 23 is lower than the air speed $v_M$ of the main suction air 19 and preferably greater than the air speed $v_1$ of the first suction air 20. According to a preferred embodiment the air speed $v_2$ of the second suction air 23 is in the range of 2-13 m/s, more preferably in the range of 3-12 m/s. In the lower region of FIG. 2 an air speed profile is shown in which the respective air speed v of the air sucked through the nonwoven web 14 and through the foraminous deposition belt 13 with the aid of the fans 21, 22 is shown as a function of the respective location in the conveying direction. It can be seen that the air speed v below the area 18 of fiber deposition is greatest and then decreases as far as the hot-air bonding device 7. Thus, a reduction in speed from the air speed $v_M$ of the main suction air 19 via the air speed $v_2$ of the second suction air 23 to the air speed $v_1$ of the first suction air 20 can be observed. The suction areas of the air flows 19, 23, 20 are preferably and in the exemplary embodiment delimited by dividing walls 29 or separated from one another. According to a preferred embodiment of the invention, these dividing walls 29 are adapted to be adjustable or settable and in this way influence is exerted on the suction or on the suction air speeds.

FIG. 3 shows a further embodiment of the apparatus according to the invention. Firstly the components and air flows as far as the first hot-air bonding device 7 are implemented as in the embodiment according to FIG. 2. In addition, in this embodiment according to FIG. 3 a second hot-air bonding device 24 is provided which preferably and in the exemplary embodiment is configured as a hot air oven. Both hot-air bonding devices 7 and 24 are used for precompaction of the nonwoven web 14. After these two precompactions the nonwoven web 14 is preferably subjected to a final solidification which was not shown in FIG. 3. Expediently this final solidification of the nonwoven web 14 is also accomplished by means of hot air. In the second hot-air bonding device 24 the nonwoven web 14 is precompacted by means of a second hot air 25 acting on the surface of the nonwoven web 14. This second hot air 25 has an air speed $v_{H2}$. It lies within the framework of the invention that the air speed $v_{H1}$ of the first hot air 15 of the first hot-air bonding device 7 is greater than the air speed $v_{H2}$ of the second hot air 25 of the second hot-air bonding device 24. According to a preferred embodiment the air speed $v_{H2}$ of the second hot air 25 is at least 20% below the air speed $v_{H1}$ of the first hot air 15. Preferably and in the exemplary embodiment furthermore the first hot air 15 of the first hot-air bonding device 7 has a higher temperature than the second hot air 25 of the second hot-air bonding device 24. According to a recommended embodiment and in the exemplary embodiment according to FIG. 3, the first hot-air bonding device 7 has a narrower air treatment region 26 when viewed in the conveying direction of the nonwoven web 14 than the second hot-air bonding device 24. It is recommended that the width of the air treatment region 26 of the first hot-air bonding device 7 viewed in the conveying direction of the nonwoven web 14 is between 35 and 110 mm. According to a preferred embodiment 5 the width of the air treatment region of the second hot air bonding device 24 viewed in the conveying direction of the nonwoven web 14 is between 110 and 1100 mm.

Preferably and in the exemplary embodiment a third suction air 27 is sucked through the nonwoven web 14 or through the foraminous deposition belt 13 underneath the second hot-air bonding device 24. This third suction air 27 has an air speed $v_3$ which preferably and in the exemplary embodiment is lower than the air speed $v_{H2}$ of the second hot air 25. According to a recommended embodiment and in the exemplary embodiment, furthermore the air speed $v_M$ of the main suction air 19 and the air speed $v_1$ of the first suction air 20 are each greater than the air speed $v_3$ of the third suction air 27.

In FIG. 3 it can also be identified that according to a preferred embodiment and in the exemplary embodiment, between the first hot-air bonding device 7 and the second hot-air bonding device 24 a fourth suction air 28 is sucked through the nonwoven web 14 and through the foraminous deposition belt 13. This fourth suction air 28 has an air speed $v_4$. Expediently this air speed $v_4$ of the fourth suction air 28 is lower than the air speed $v_1$ of the first suction air 20 and greater than the air speed $v_3$ of the third suction air 27. According to a preferred embodiment the air speed $v_4$ of the fourth suction air 28 is smaller than 3 m/s, more preferably smaller than 2 m/s. In the lower region of FIG. 3 a preferred air speed profile is shown which in turn shows the air speed v as a function of the location underneath the conveyor or the foraminous deposition belt 13. It can be seen that according to a preferred embodiment and in the exemplary embodiment, the air speed v decreases from the air speed $v_M$ of the main suction air 19 towards the air speed $v_3$ of the third suction air 27. It is also shown in FIG. 3 that the individual suction areas—as in the exemplary embodiment of FIG. 2—are again separated from one another by dividing walls 29. It is recommended and in the exemplary embodiment that these dividing walls 29 are provided to be adjustable so that the suction cross-section of the individual suction air flows can be varied and thus the suction or the suction speed can be varied. This adjustment possibility has proved particularly successful within the framework of the invention. The suction or the suction speeds can furthermore also be controlled and/or regulated via the fans 21, 22.

FIG. 4 shows a further recommended embodiment of the invention. This embodiment differs from the embodiment according to FIG. 3 merely in that the second hot-air bonding device 24 is here not configured as a hot air oven but like the first hot-air bonding device 7 as a hot air knife. Both hot-air bonding devices 7, 24 or both hot air knives are provided for the precompaction of the nonwoven web 14. Expediently here after the two precompactions, a final solidification of the nonwoven web 14—not shown in FIG. 4—takes place, which is preferably carried out with hot air.

The air speed profiles in FIGS. 2, 3 and 4 show that the air speed v of the sucked air decreases or decreases continuously from the area 18 of fiber deposition in the conveying direction. As a result of this adjustment of the air speeds v according to the invention, negative blow-back effects onto the nonwoven web 14 can be avoided which particularly occur in transition regions between different suctions or in transition regions between different air flows. The invention is in this respect based on the finding that a defect-free homogeneous nonwoven web 14 can be produced with the measures according to the invention.

FIG. 5 illustrates a preferred embodiment of an apparatus according to the invention for producing a multilayer nonwoven web 14 made of a plurality of spunbond webs S, in the exemplary embodiment of three spunbond webs S1, S2 and S3. In order to produce the individual spunbond webs S for the multilayer nonwoven web 14, in each case a spinning beam or a spinneret 2 is used for spinning the respective continuous filaments 1. In this case, in order to produce each spunbond web 51, S2 and S3, in each case a spunbond apparatus explained above is used. After deposition of each spunbond web S1, S2 and S3, a pre-compaction takes place in each case with two hot-air bonding devices 7, 24 in the form of hot air knives. The air flows and air speeds preferably each correspond to those which were explained in connection with FIGS. 3 and 4. Each spunbond web S1, S2 and S3 therefore undergoes a double precompaction with the hot-air bonding devices 7, 24 after deposition on the foraminous deposition belt 13. Only after a laminate made of the three spunbond webs S1, S2 and S3 has been completed does a final solidification then preferably take place with a final solidification device 30.

The invention claimed is:

1. A method of making a nonwoven fabric of crimped synthetic filaments, the method comprising the steps of:

spinning the synthetic filaments;

depositing the spun filaments on a conveyor at a deposition location as a nonwoven web;

drawing main suction air down through the web and the conveyor at a main suction-air speed at the deposition location;

prebonding the deposited nonwoven web with a hot-air knife constituting a first hot-air bonding device downstream in a travel direction of the conveyor from the deposition location by blowing first hot air down at the web on the conveyor at a first hot-air speed smaller than the main suction-air speed and simultaneously drawing air down through the conveyor and web beneath the first hot-air bonding device at a first suction-air speed smaller than the main suction-air speed and equal to or greater than the first hot-air speed;

drawing second suction air down through the web and conveyor between the deposition location and the hot-air knife at a second suction-air speed smaller than the main suction-air speed and greater than the first suction-air speed; and bonding the deposited nonwoven web on the conveyor with a second hot-air bonding device downstream of the hot-air knife by blowing second hot air down at the deposited nonwoven web on the conveyor at a second hot-air speed that is less than the first hot-air speed.

2. The method according to claim 1, wherein the nonwoven web is a spunbond and the filaments are continuous, the method further comprising the steps between the steps of spinning and deposition of:

cooling the spun filaments, stretching the cooled spun filaments.

3. The method according to claim 1, wherein the filaments are bicomponent or multicomponent and at least partially formed of polyolefin.

4. The method according to claim 1, wherein the filaments are spun with side-by-side configuration or with an eccentric core-sheath configuration.

5. The method according to claim 1, wherein the first hot air has a higher temperature than the second hot air.

6. The method according to claim 1, wherein the hot-air knife has a smaller air treatment area measured in the travel direction than the second hot-air bonding device.

7. The method according to claim 1, further comprising the step of:

drawing third suction air down through the web and the conveyor beneath the second hot-air bonding device at a third suction-air speed smaller than the second suction-air speed.

8. The method according to claim 7, wherein the main suction-air speed and the first suction-air speed are each greater than the third suction-air speed.

9. The method according to claim 7, further comprising the step of:

drawing fourth suction air down through the web and the conveyor between the hot-air knife and the second hot-air bonding device at a fourth suction-air speed that is less than the first suction-air speed and greater than the third-suction air speed.

10. The method according to claim 1, further comprising the step of:

heating the second hot air to between 80° C. and 180° C.

11. The method according to claim 1, wherein the hot-air knife and the second bonding device preconsolidate the web, the method further comprising the step of:

finally consolidating the web with hot air downstream in the travel direction of the second bonding device.

12. The method according to claim 1, wherein the conveyor displaces the web in the travel direction at a speed of more than 120 m/min.

13. The method according to claim 1, further comprising the steps, after forming a first nonwoven web according to the steps of claim 1 of forming a second nonwoven web according to the steps of claim 1; and laminating the second nonwoven web onto the first web.

14. The method according to claim 1, wherein each nonwoven web has downstream of the respective second bonding device a bulk density of at most 0.06 $g/cm^3$ and a strength of more than 0.6 (N/5 cm)/($g/m^2$).

15. The method according to claim 1, further comprising the step of:

passing the spun filaments immediately above the deposition location through a diffuser.

* * * * *